US009919843B2

(12) United States Patent
Pulst et al.

(10) Patent No.: US 9,919,843 B2
(45) Date of Patent: Mar. 20, 2018

(54) DETACHABLE HANDLE FOR A CONTAINER

(71) Applicants: Brandon Pulst, Penn, ND (US); Joshua Goldade, Grand Forks, ND (US)

(72) Inventors: Brandon Pulst, Penn, ND (US); Joshua Goldade, Grand Forks, ND (US)

( * ) Notice: Subject to any disclaimer, the term of this patent is extended or adjusted under 35 U.S.C. 154(b) by 197 days.

(21) Appl. No.: 14/856,110

(22) Filed: Sep. 16, 2015

(65) Prior Publication Data

US 2016/0075480 A1 Mar. 17, 2016

Related U.S. Application Data

(60) Provisional application No. 62/051,465, filed on Sep. 17, 2014.

(51) Int. Cl.

| | |
|---|---|
| ***B65D 25/28*** | (2006.01) |
| ***B67B 7/16*** | (2006.01) |
| ***A47G 23/02*** | (2006.01) |
| *A47G 19/22* | (2006.01) |

(52) U.S. Cl.

CPC ..... *B65D 25/2829* (2013.01); *A47G 23/0216* (2013.01); *A47G 23/0241* (2013.01); *A47G 23/0266* (2013.01); *B67B 7/16* (2013.01); *A47G 19/2222* (2013.01); *B65D 2525/285* (2013.01)

(58) Field of Classification Search

CPC ..... A47G 23/0216; A47G 23/0241; A47G 23/0266; A47G 19/2222; B65D 25/2829; B65D 2525/285; B67B 7/16

USPC ..... 220/755

See application file for complete search history.

(56) References Cited

U.S. PATENT DOCUMENTS

| | | | | | |
|---|---|---|---|---|---|
| 2,088,387 | A * | 7/1937 | Rice, Jr. | A47G 23/0241 | 206/446 |
| 2,801,743 | A * | 8/1957 | Geen | A47G 23/0258 | 206/434 |
| 2,991,907 | A * | 7/1961 | Kinnison | A47G 23/0216 | 16/425 |
| 3,014,621 | A * | 12/1961 | Povitz | A47G 23/0266 | 220/284 |
| 3,029,975 | A * | 4/1962 | Aiello | A47G 23/0266 | 220/742 |
| 3,107,028 | A * | 10/1963 | De Robertis | A47G 23/0216 | 215/395 |
| 3,189,937 | A * | 6/1965 | Sciortino | A47G 23/0266 | 294/33 |
| 3,285,456 | A * | 11/1966 | Pewitt | A47G 23/0241 | 215/12.1 |
| 3,820,511 | A * | 6/1974 | Katzakian | A47G 23/0266 | 222/475 |

(Continued)

*Primary Examiner* — Anthony Stashick
*Assistant Examiner* — James Way
(74) *Attorney, Agent, or Firm* — Duft Bornsen & Fettig LLP

(57) ABSTRACT

A detachable handle for attaching to a container. In one embodiment, the handle includes a grip member for grasping by a person, an upper clip member that extends from the grip member and includes one or more grooves for coupling to a top rim of the container, and a base member that extends from the grip member. The base member has a bottom surface that is substantially flat for resting on a flat surface, and a top surface that includes a circular recess for holding a bottom of the container.

17 Claims, 8 Drawing Sheets

(56) References Cited

U.S. PATENT DOCUMENTS

| | | | | | |
|---|---|---|---|---|---|
| 3,979,011 | A * | 9/1976 | Schleicher | A47G 23/0266 | 220/287 |
| 4,898,297 | A * | 2/1990 | Wheeler | A47G 23/0266 | 220/742 |
| 4,966,303 | A * | 10/1990 | Jones | A47G 23/0266 | 215/13.1 |
| 5,505,330 | A * | 4/1996 | Nunes | A47G 23/0266 | 220/742 |
| D372,844 | S * | 8/1996 | Nunes | D7/622 | |
| 5,683,009 | A * | 11/1997 | King | B44D 3/128 | 220/696 |
| 2007/0012140 | A1* | 1/2007 | Howlett | A47G 23/0216 | 81/3.09 |
| 2008/0017774 | A1* | 1/2008 | Jackson | A47G 23/0216 | 248/311.2 |
| 2008/0237242 | A1* | 10/2008 | Gifford | A47G 23/0216 | 220/592.16 |
| 2010/0282767 | A1* | 11/2010 | Wren | A47G 23/0216 | 220/710.5 |

* cited by examiner

DETACHABLE HANDLE FOR A CONTAINER

RELATED APPLICATIONS

This non-provisional application claims priority to U.S. provisional application 62/051,465, which was filed on Sep. 17, 2014. The provisional application is incorporated by reference as if fully provided herein.

FIELD OF THE INVENTION

The invention relates to the field of handles for containers.

BACKGROUND

Liquid or beverage containers, which do not have a permanent handle, can sometimes be difficult or uncomfortable to hold. For example, a beverage container may be a soda can, a beer can, a glass (e.g., pint glass), a bottle, etc. If the beverage is warm or cold, the container may become uncomfortably warm or cold to the touch. Also, a cold liquid may cause condensation to form on the outer surface of the container, which may make the container slippery.

SUMMARY

Embodiments described herein provide for a detachable handle for containers. The handle described herein may be attached to a container and used to assist a person in handling or pouring liquid from the container. The handle can then be removed from the container, and attached to another container. Therefore, the handle allows a person to comfortably handle or use the container regardless of whether the container is hot, cold, wet, dirty, etc.

One embodiment comprises a detachable handle for attaching to a container. The detachable handle includes a grip member for grasping by a person, an upper clip member, and a base member. The upper clip member extends from the grip member, and includes one or more grooves for coupling to a top rim of the container. The base member also extends from the grip member. The base member has a bottom surface that is substantially flat for resting on a flat surface, and a top surface that includes a circular recess for holding a bottom of the container. The container is therefore secured between the upper clip member and the base member.

In another embodiment, the detachable handle includes a first hinge mechanism that connects the upper clip member to the grip member, and a second hinge mechanism that connects the base member to the grip member.

In another embodiment, the upper clip member includes a series of parallel grooves that are curved lengthwise.

In another embodiment, the grip member has at least one flat surface for receiving a mark, such as a name, a logo, an advertisement, etc.

In another embodiment, the base member includes a magnet to secure the bottom surface of the base member to the flat surface which is magnetic.

In another embodiment, the grip member includes at least one protuberance for assisting a person in grasping the grip member.

In another embodiment, the grip member includes a slide mechanism for varying a length of the grip member.

In another embodiment, the upper clip member includes a hole to accommodate a drinking straw.

In another embodiment, the base member includes a circular groove in the bottom of the circular recess for holding the bottom of a beverage can.

In another embodiment, the base member includes a hole in the bottom of the circular recess for a drain.

In another embodiment, the base member includes a bottle opener in the hole for the drain.

The features, functions, and advantages that have been discussed can be achieved independently in various embodiments or may be combined in yet other embodiments, further details of which can be seen with reference to the following description and drawings.

DESCRIPTION OF THE DRAWINGS

Some embodiments of the present invention are now described, by way of example only, and with reference to the accompanying drawings. The same reference number represents the same element or the same type of element on all drawings.

DESCRIPTION OF THE EMBODIMENTS

The figures and the following description illustrate specific exemplary embodiments. It will be appreciated that those skilled in the art will be able to devise various arrangements that, although not explicitly described or shown herein, embody the principles described herein and are included within the contemplated scope of the claims that follow this description. Furthermore, any examples described herein are intended to aid in understanding the principles of the disclosure, and are to be construed as being without limitation. As a result, this disclosure is not limited to the specific embodiments or examples described below, but by the claims and their equivalents.

Figure 1:
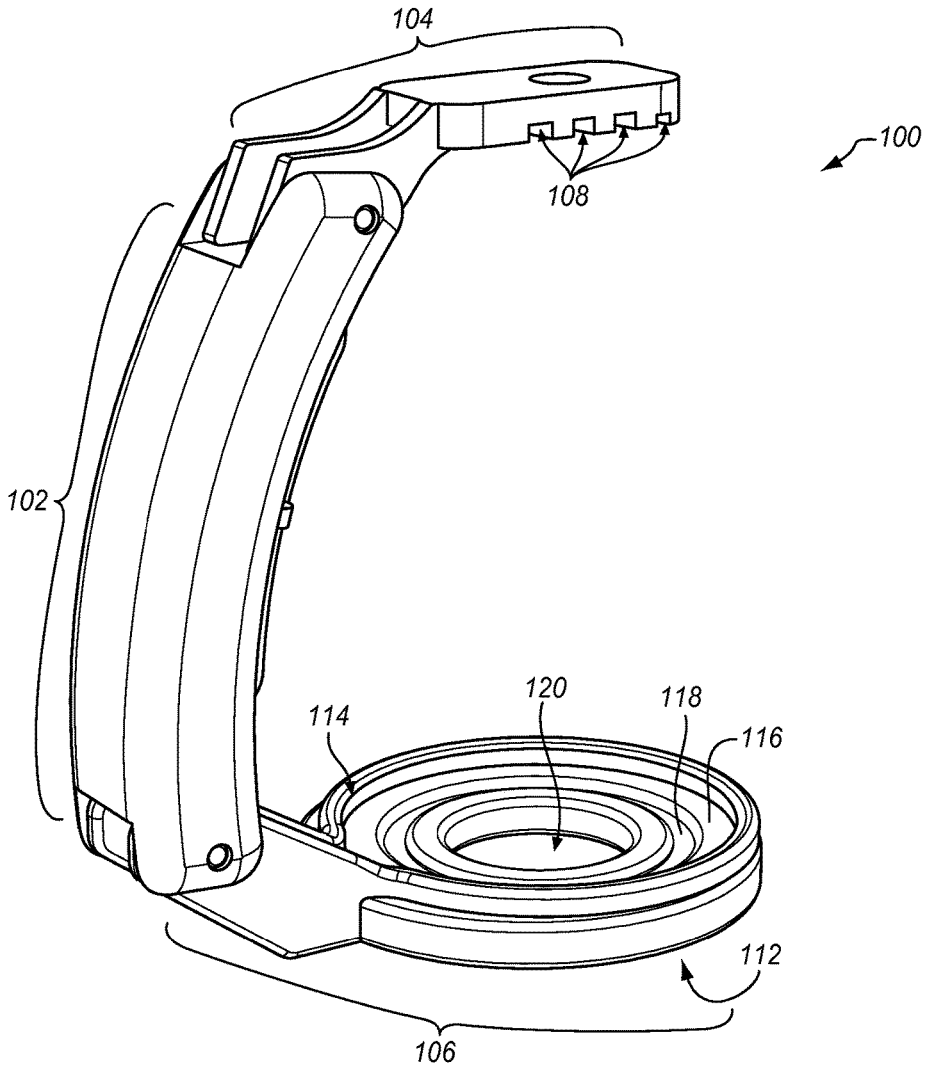
FIGS. 1-3 illustrate a detachable handle for a container in an exemplary embodiment.
Figure 2:
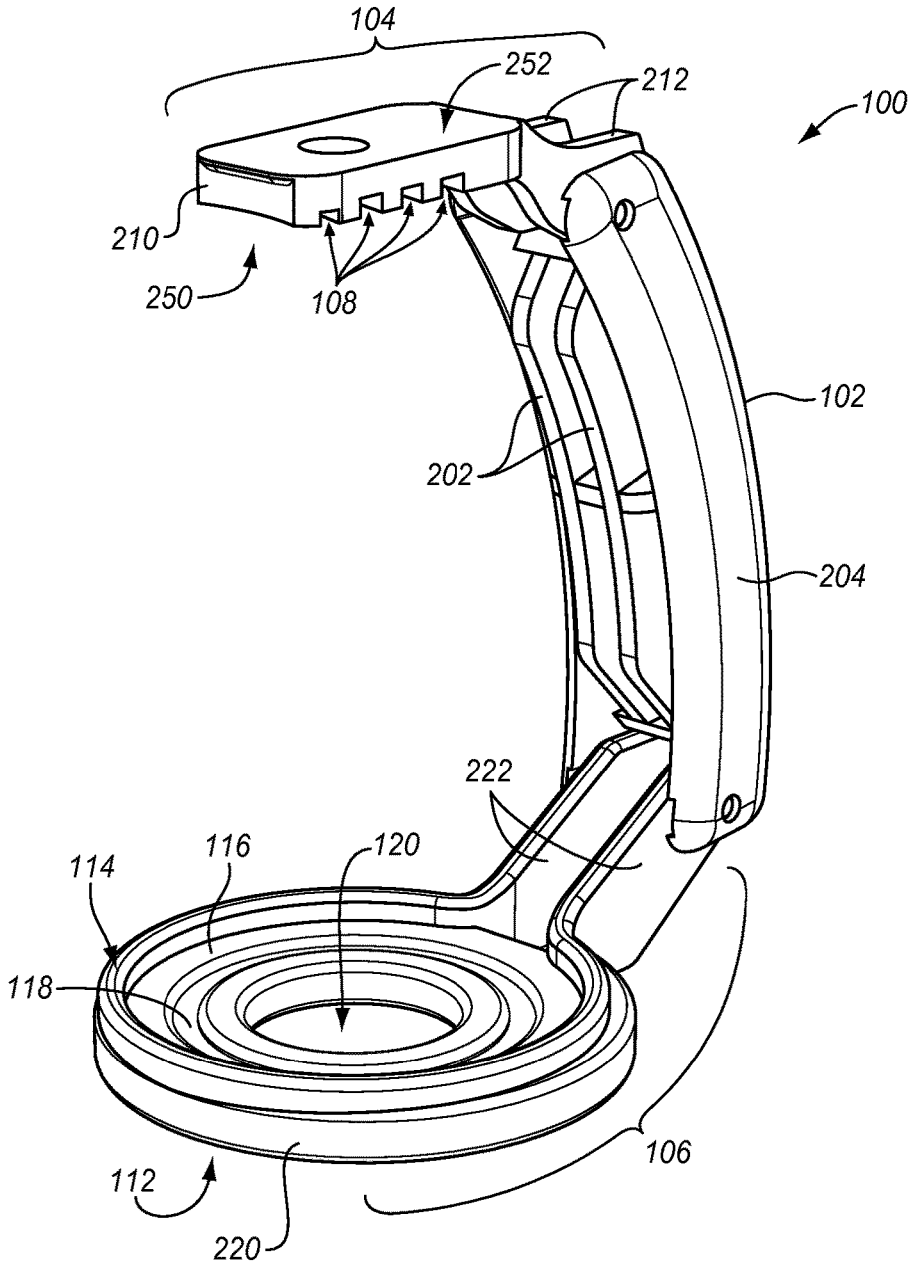
Figure 3:
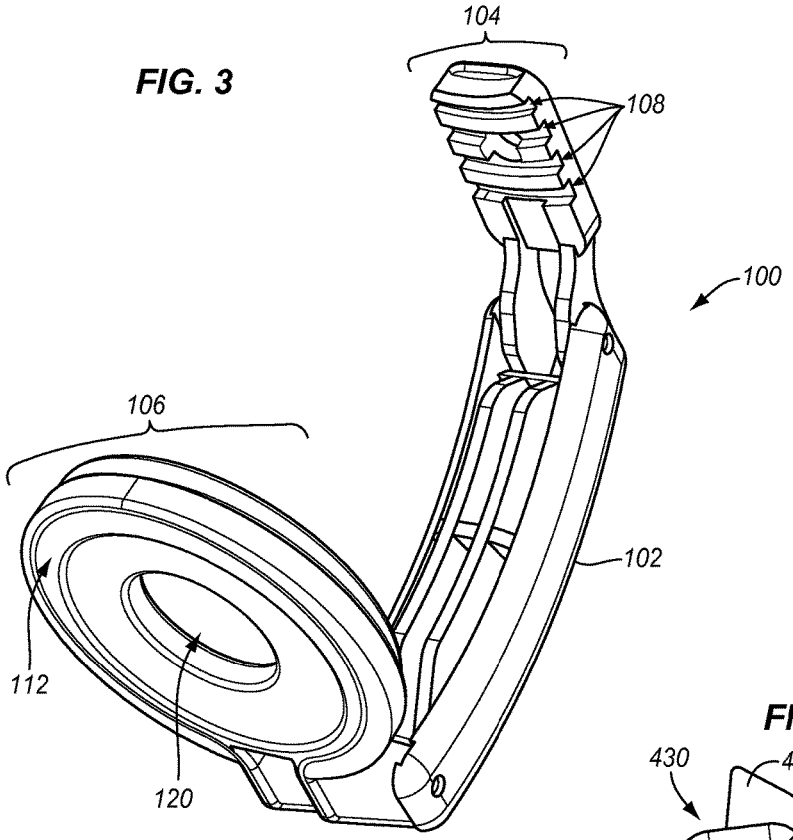

FIGS. 1-3 illustrate a detachable handle 100 for a container in an exemplary embodiment. Handle 100 is configured to be temporarily attached to the container to assist a user (i.e., a person) in holding the container. A container is defined as any vessel that contains a liquid. One example of a container as described herein is a beverage container, such as an aluminum can (e.g., 12 ounce), a glass, a cup (e.g., a Solo® cup), a bottle, a jar, a paint can, etc. It is assumed for this embodiment that the container does not have a permanent handle.

Handle 100 includes a grip member 102, an upper clip member 104, and a base member 106. Grip member 102 is an elongated piece that is designed to be gripped by the hand of a person. The size and shape of grip member 102 may vary as desired to provide a comfortable object for a person to grab and hold onto. The shape of grip member 102 as shown in FIG. 1 is curved from one end to the other, but it may have different shapes in other embodiments.

Upper clip member 104 extends from an upper portion of grip member 102. Upper clip member 104 is designed to clip or attach to the rim on top of a container. Upper clip member 104 includes one or more grooves 108 for attaching to the rim of the container. Grooves 108 are cut into a bottom surface of upper clip member 104, and the rim of the container slides into grooves 108. Because most containers have a circular rim, grooves 108 may be curved lengthwise to match the circular shape of the rim (see FIG. 3). To accommodate containers of different diameters, the grooves 108 may be aligned in parallel along the bottom surface of upper clip member 104. Although the structure of upper clip member 104 may vary, in this embodiment, upper clip member 104 includes a clip plate 210 that connects to grip member 102 by a pair of arms 212 (see FIG. 2). Clip plate 210 has a bottom surface 250 and a top surface 252. Grooves 108 are cut into the bottom surface 250 of clip plate 210.

Base member 106 extends from a lower portion of grip member 102 in the same direction as upper clip member 104. Base member 106 is designed to support the bottom of the container while upper clip member 104 attaches to the rim of the container. Base member 106 includes a bottom surface 112 that is substantially flat for resting on a flat surface, such as a counter-top, a table, etc. Base member 106 may include one or more magnets (not visible in FIGS. 1-3) to secure bottom surface 112 to a flat surface that is magnetic, such as the trunk of a car, a metal counter-top, a tailgate, etc. Base member 106 may also include a coating on bottom surface 112 to inhibit sliding of handle 100 off of surfaces.

Base member 106 also includes a top surface 114 having a circular recess 116 for holding the bottom of the container. Circular recess 116 has a diameter that is at least as large as the diameter of the bottom of the container so that the bottom of the container is able to slide into circular recess 116. In one embodiment, the bottom of circular recess 116 includes one or more circular grooves 118 for holding the bottom of a beverage can. The diameter of circular groove 118 is designed to match the diameter of a lip on the bottom of a beverage can (e.g., a 12-ounce aluminum can). Base member 106 may also include a hole 120 in the bottom of circular recess 116 to act as a drain to empty any liquid (e.g., condensation) that accumulates in circular recess 116. Although the structure of base member 106 may vary, in this embodiment, base member 106 includes a support plate 220 that connects to grip member 102 by a pair of arms 222. Support plate 220 includes circular recess 116 on its top surface.

To assist a person in holding handle 100, grip member 102 may include one or more protuberances 202 (see FIG. 2), such as bumps, ridges, knobs, etc. Protuberances 202 may protrude from any side of grip member 102. In FIG. 2, protuberances 202 protrude from the side of grip member 102 that faces toward the container. Grip member 102 may also have one or more flat surfaces 204 for receiving a mark. Flat surface 204 may be used for printing a name, a logo, an advertisement, etc., or for affixing a sticker or label. Upper clip member 104 may also have a flat surface 252 for receiving a mark, as well as base member 106 having a flat surface for receiving a mark.

Figure 4:
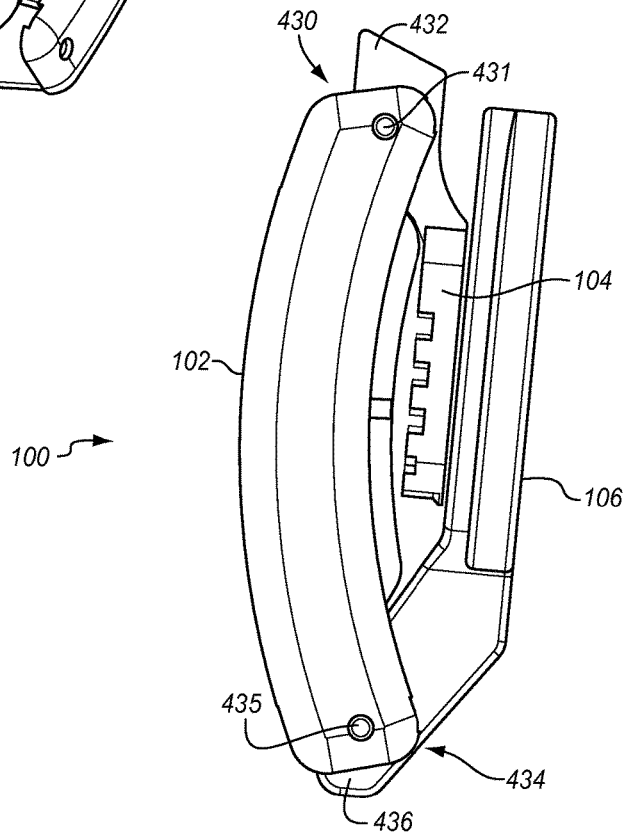
FIG. 4 illustrates the handle when folded in an exemplary embodiment.

In one embodiment, handle 100 may be collapsible as illustrated in FIG. 4. Upper clip member 104 may connect to grip member 102 by a hinge mechanism 430. Through hinge mechanism 430, upper clip member 104 is able to pivot toward grip member 102 when hinge mechanism 430 is closed (as shown in FIG. 4). In this position, upper clip member 104 is folded onto grip member 102. Upper clip member 104 is able to pivot away from grip member 102 when hinge mechanism 430 is open so that upper clip member 104 extends from grip member 102 (see FIGS. 1-3). The configuration of hinge mechanism 430 may vary as desired. As illustrated in FIG. 4, grip member 102 may include a pair of holes 431 at its upper portion that mate with a pair of pins (not visible in FIG. 4) that project from upper clip member 104. Hinge mechanism 430 also includes a stop component 432 that restricts how far hinge mechanism 430 is allowed to open. Although not shown in FIG. 4, one or more springs may be attached to hinge mechanism 430 that apply a force towards the closed position of hinge mechanism 430.

Likewise, base member 106 may connect to grip member 102 by a hinge mechanism 434. Through hinge mechanism 434, base member 106 is able to pivot toward grip member 102 when hinge mechanism 434 is closed (as shown in FIG. 4). In this position, base member 106 is folded onto grip member 102. Base member 106 is able to pivot away from grip member 102 when hinge mechanism 434 is open so that base member 106 extends from grip member 102 (see FIGS. 1-3). The configuration of hinge mechanism 434 may also vary as desired. As illustrated in FIG. 4, grip member 102 may include a pair of holes 435 at its lower portion that mate with a pair of pins (not visible in FIG. 4) that project from base member 106. Hinge mechanism 434 also includes a stop component 436 that restricts how far hinge mechanism 434 is allowed to open. Although not shown in FIG. 4, one or more springs may be attached to hinge mechanism 434 that apply a force towards the closed position of hinge mechanism 434.

Figure 5:
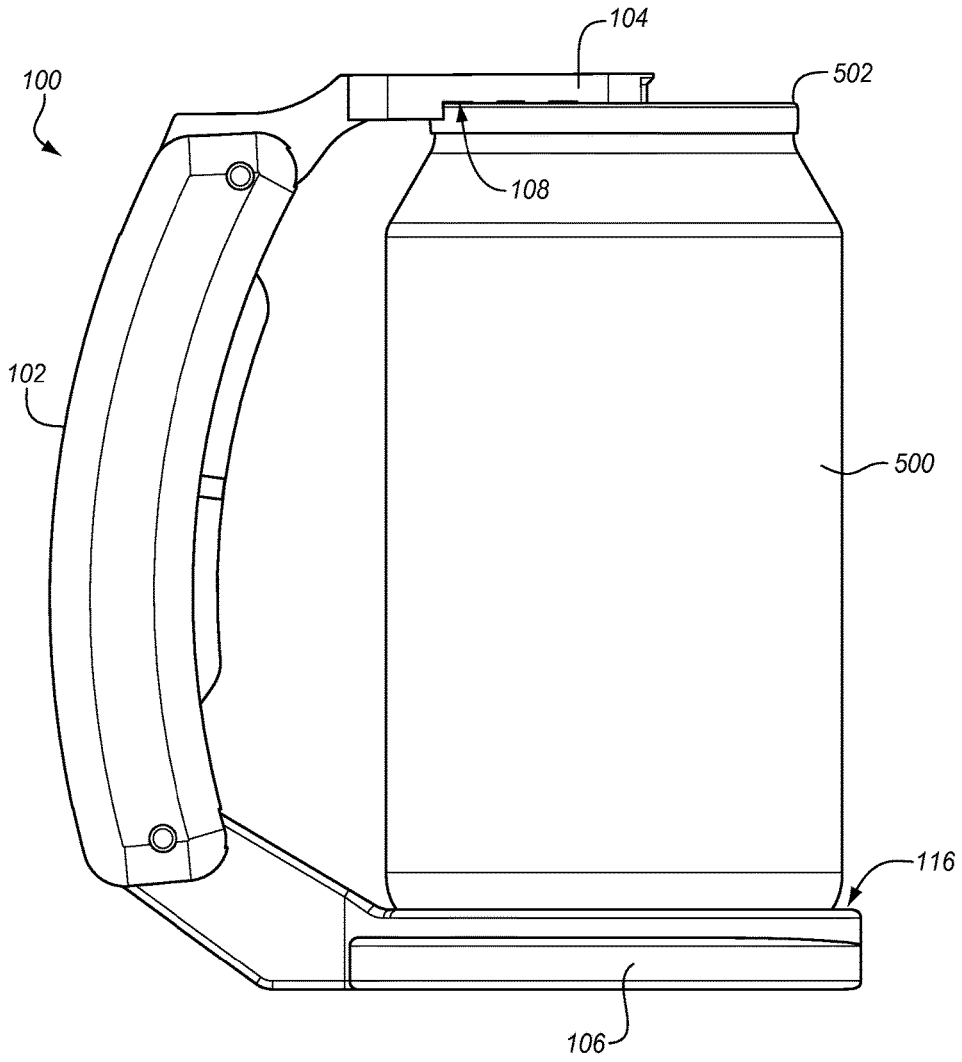
FIG. 5 illustrates a handle attached to a beverage can in an exemplary embodiment.

FIG. 5 illustrates handle 100 attached to a beverage can 500 in an exemplary embodiment. As is evident in FIG. 5, upper clip member 104 attaches to a lid 502 of can 500. More particularly, a groove 108 in the bottom surface of upper clip member 104 attaches to lid 502. At the same time, base member 106 holds the bottom of can 500 in circular recess 116. Grip member 102, upper clip member 104, and/or base member 106 may be formed from a flexible material, such as plastic. Therefore, handle 100 may flex between upper clip member 104 and base member 106. When placing handle 100 on can 500, the spacing between upper clip member 104 and base member 106 may be stretched. After being placed on can 500, handle 100 contracts to apply pressure between upper clip member 104 and base member 106 to secure handle 100 onto can 500.

Figure 6:
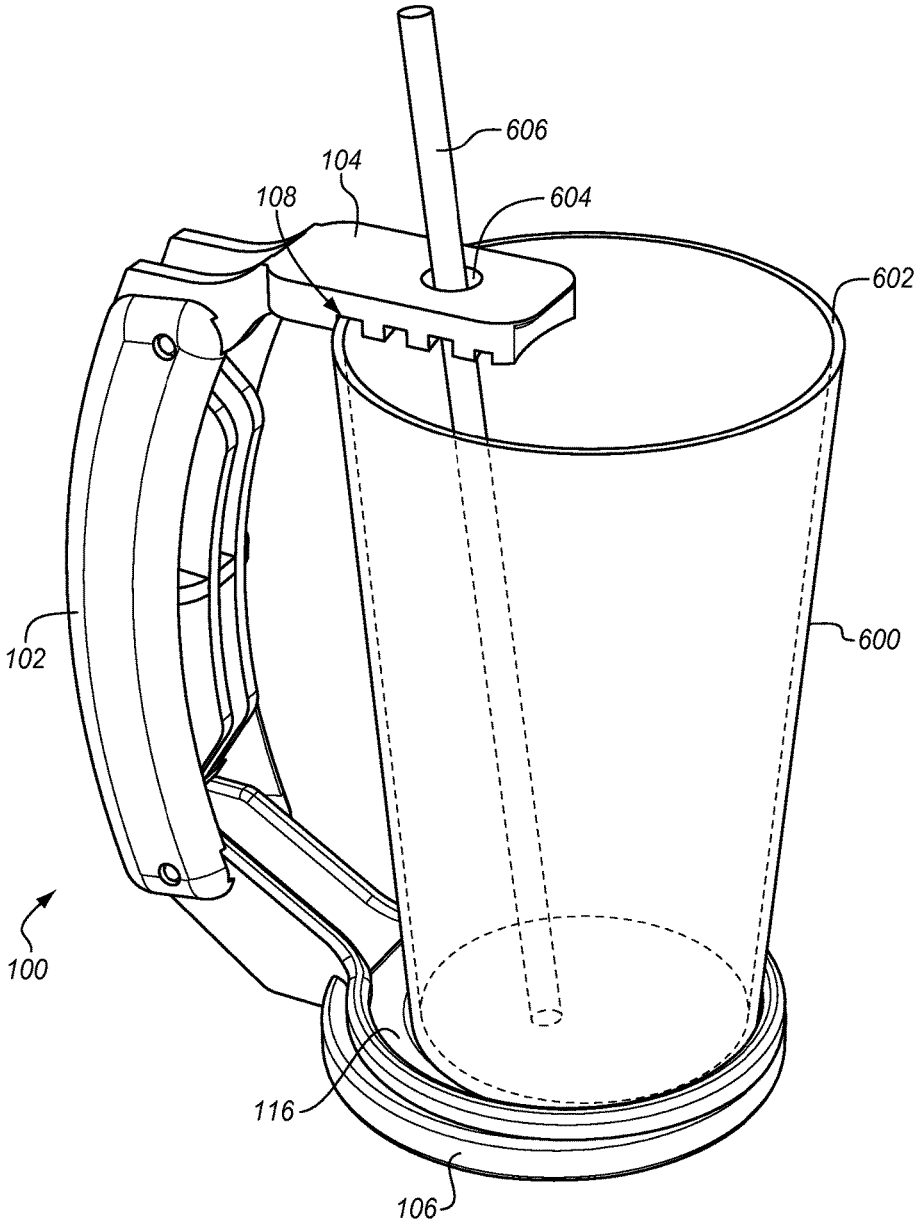
FIG. 6 illustrates a handle attached to a glass in an exemplary embodiment.

FIG. 6 illustrates handle 100 attached to a glass 600 in an exemplary embodiment. As is evident in FIG. 6, upper clip member 104 attaches to a lid 602 of glass 600. More particularly, a groove 108 in the bottom surface of upper clip member 104 attaches to lid 602. At the same time, base member 106 holds the bottom of glass 600 in circular recess 116. FIG. 6 also shows that upper clip member 104 may include a hole 604 to accommodate a drinking straw 606.

Figure 7:
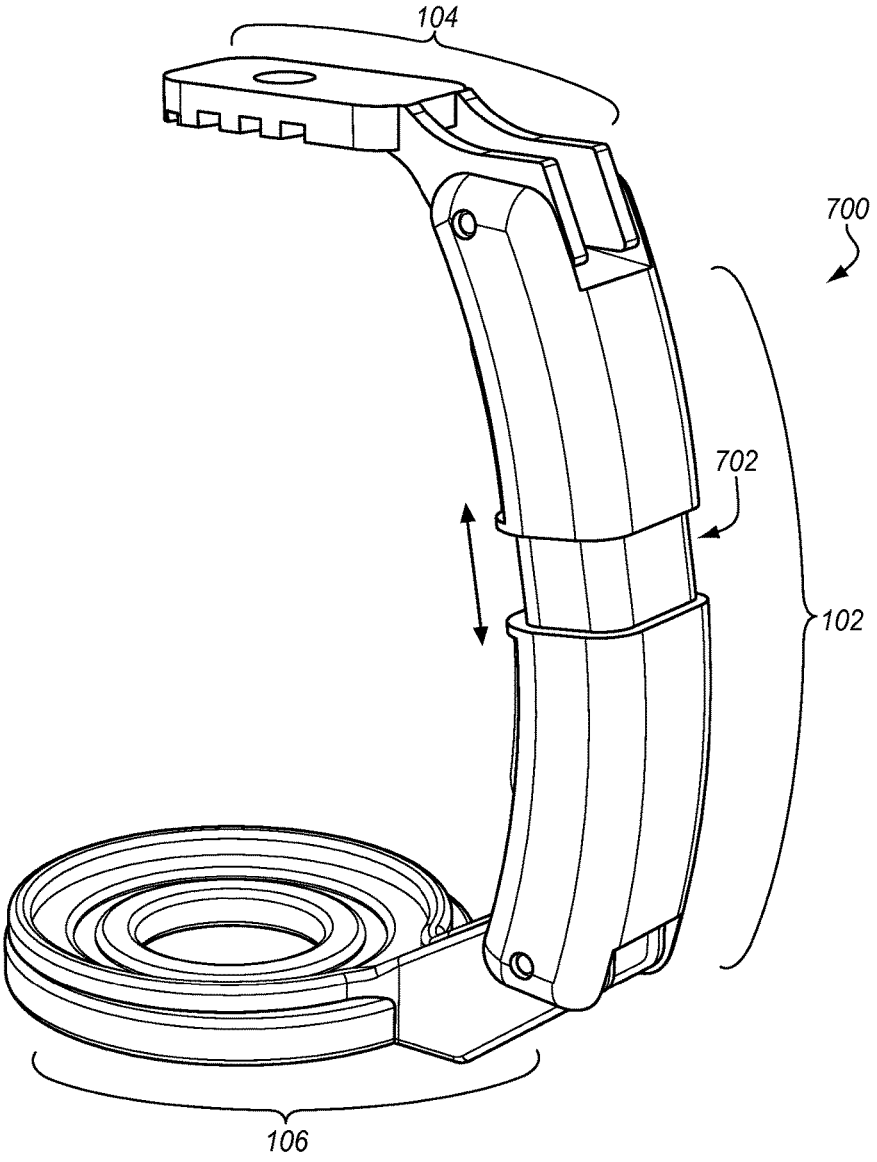
FIG. 7 illustrates an extendible handle in an exemplary embodiment.

In one embodiment, handle 100 may be extendible to accommodate containers having different heights. FIG. 7 illustrates an extendible handle 700 in an exemplary embodiment. The structure of handle 700 is similar to handle 100, except that grip member 102 includes a slide mechanism 702. Slide mechanism 702 varies the length of grip member 102, and consequently, the spacing between upper clip member 104 and base member 106. Therefore, handle 700 may be attached to containers of different heights.

Figure 8:
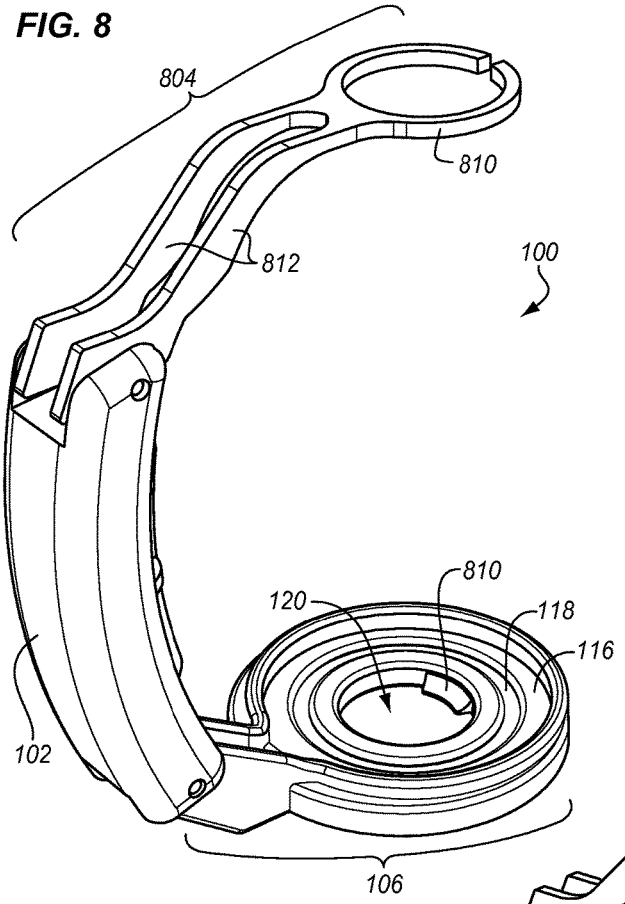
FIG. 8 illustrates a handle for a bottle in an exemplary embodiment.

Upper clip member 104 of handle 100 may be replaceable to accommodate different types of containers. FIG. 8 illustrates handle 100 for a bottle in an exemplary embodiment. In this embodiment, handle 100 includes an upper clip member 804 that is designed to clip or attach to the neck of a bottle. Although the structure of upper clip member 804 may vary, in this embodiment, upper clip member 804 includes a ring 810 that connects to grip member 102 by a pair of arms 812. The inner diameter of ring 810 is sized such that a bottle can slide into ring 810, and ring 810 contacts some portion of the neck of the bottle.

Figure 9:
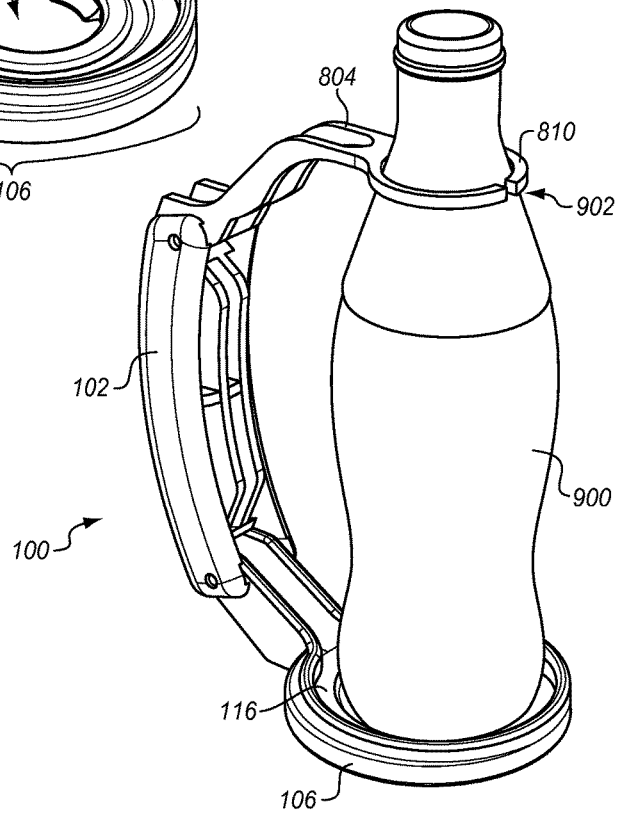
FIG. 9 illustrates a handle attached to a bottle in an exemplary embodiment.

Base member 106 is again designed to support the bottom of the bottle while upper clip member 804 attaches to the neck of the bottle. As with previous embodiments, base member 106 includes a circular recess 116 for holding the bottom of the bottle. Circular recess 116 has a diameter that is at least as large as the diameter of the bottom of the bottle so that the bottom of the bottle is able to slide into circular recess 116. In one embodiment, base member 106 may also include a bottle opener 810 in the hole 120 that forms the drain. FIG. 9 illustrates handle 100 attached to a bottle 900 in an exemplary embodiment. As is evident in FIG. 9, upper clip member 804 attaches to the neck 902 of bottle 900. More particularly, bottle 900 slides through ring 810, and ring 810 contacts the neck 902 of bottle 900. At the same time, base member 106 holds the bottom of bottle 900 in circular recess 116.

Figure 10:
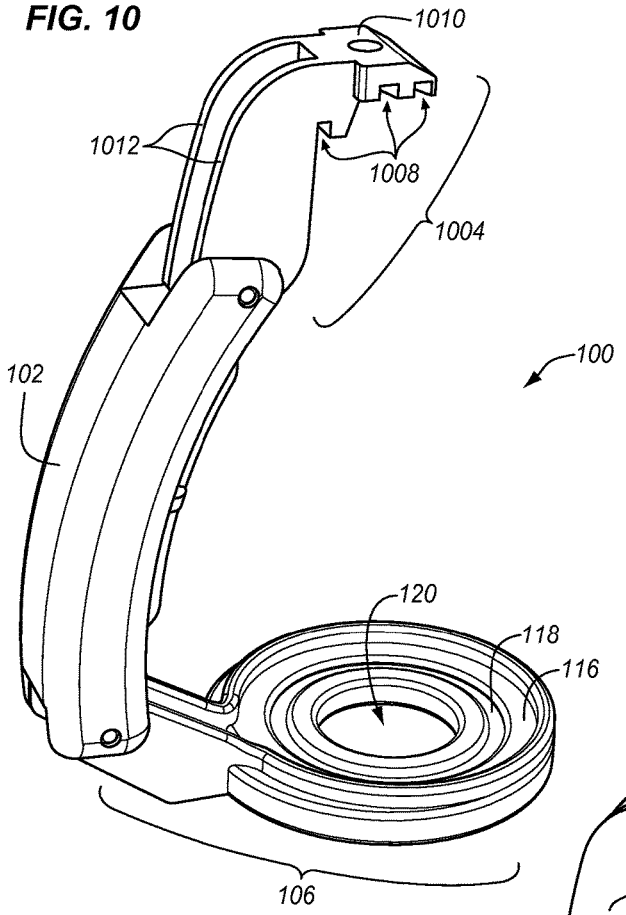
FIG. 10 illustrates a handle for a taller container in an exemplary embodiment.
Figure 11:
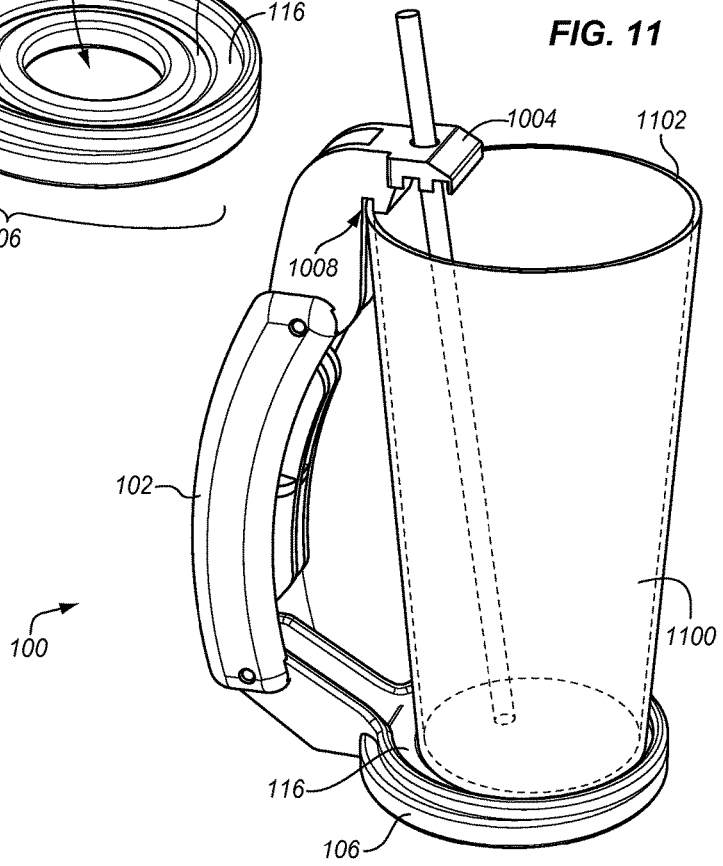
FIG. 11 illustrates a handle attached to a tall glass in an exemplary embodiment.

FIG. 10 illustrates handle 100 for a taller container in an exemplary embodiment. In this embodiment, handle 100 includes an upper clip member 1004 that is designed to clip or attach to the rim on top of a tall container, such as a pint glass, a 16-ounce can, etc. The structure of upper clip member 1004 allows for an increased spacing between upper clip member 1004 and base member 106. Upper clip member 1004 includes one or more grooves 1008 for attaching to the rim of the container. Grooves 1008 are cut into a bottom surface of upper clip member 1004, and the rim of the container slides into grooves 1008. Because most containers have a circular rim, grooves 1008 may be curved lengthwise to match the circular shape of the rim (not visible in FIG. 10). Although the structure of upper clip member 1004 may vary, in this embodiment, upper clip member 1004 includes a clip plate 1010 that connects to grip member 102 by a pair of arms 1012. Grooves 1008 are cut into the bottom surface of clip plate 1010. Arms 1012 extend upward from grip member 102 to increase the spacing between upper clip member 1004 and base member 106. FIG. 11 illustrates handle 100 attached to a tall glass 1100 in an exemplary embodiment. As is evident in FIG. 11, upper clip member 1004 attaches to a lid 1102 of glass 1100. More particularly, a groove 1008 in the bottom surface of upper clip member 1004 attaches to lid 1102. At the same time, base member 106 holds the bottom of glass 1100 in circular recess 116.

Any of the above embodiments may be combined to form a handle as desired.

Although specific embodiments were described herein, the scope of the invention is not limited to those specific embodiments. The scope of the invention is defined by the following claims and any equivalents thereof.

We claim:

1. An apparatus comprising:

a detachable handle for attaching to a container, the detachable handle comprising:

a grip member for grasping by a person;

an upper clip member that extends from an upper portion of the grip member; and a base member that extends from the grip member from a lower portion of the grip member in the same direction as the upper clip member, wherein the base member has a bottom surface that is substantially flat for resting on a flat surface, and a top surface that includes a circular recess for holding a bottom of the container;

wherein the upper clip member includes a plurality of grooves cut into a bottom surface of the upper clip member and that face toward the base member to allow a groove of the plurality to engage with a top rim of the container;

wherein the upper clip member attaches to only a portion of a circumference of the top rim of the container via the groove when the detachable handle is attached to the container wherein the detachable handle is collapsible, and further includes: a first hinge mechanism that connects the upper clip member to the grip member so that the upper clip member is able to pivot towards the grip member; and a second hinge mechanism that connects the base member to the grip member so that the base member is able to pivot towards the grip member.

2. The apparatus of claim 1 wherein:

the plurality of grooves are aligned in parallel on the bottom surface of the upper clip member to accommodate containers of different diameters, and are curved lengthwise to match a circular shape of the top rim of the container.

3. The apparatus of claim 1 wherein:

the grip member has at least one flat surface for receiving a mark.

4. The apparatus of claim 1 wherein:

the base member includes a magnet to secure the bottom surface of the base member to the flat surface which is magnetic.

5. The apparatus of claim 1 wherein:

the grip member includes at least one protuberance.

6. The apparatus of claim 1 wherein:

the grip member includes a slide mechanism for varying a length of the grip member.

7. The apparatus of claim 1 wherein:

the upper clip member includes a hole to accommodate a drinking straw.

8. The apparatus of claim 1 wherein:

the base member includes a circular groove in the bottom of the circular recess for holding the bottom of a beverage can.

9. The apparatus of claim 1 wherein:

the base member includes a hole in the bottom of the circular recess for a drain, and a bottle opener in the hole.

10. An apparatus comprising:

a detachable handle for attaching to a beverage container, the detachable handle comprising:

a grip member for grasping by a person;

an upper clip member that connects to an upper portion of the grip member by a first hinge mechanism, wherein the upper clip member pivots away from the grip member to extend from the grip member when the first hinge mechanism is open and pivots toward the grip member when the first hinge mechanism is closed; and a base member that connects to a lower portion of the grip member by a second hinge mechanism, wherein the base member pivots away from the grip member to extend from the grip member when the second hinge mechanism is open and pivots toward the grip member when the second hinge mechanism is closed;

wherein the upper clip member includes a plurality of grooves cut into a bottom surface of the upper clip member and that face toward the base member when the first hinge mechanism and the second hinge mechanism are open to allow a groove of the plurality to engage with a top rim of the beverage container;

wherein the upper clip member attaches to only a portion of a circumference of the top rim of the beverage container via the groove when the detachable handle is attached to the beverage container;

wherein the base member has a bottom surface that is substantially flat for resting on a flat surface, and a top surface that includes a circular recess for holding a bottom of the beverage container.

11. The apparatus of claim 10 wherein:

a length of the grip member defines a spacing between the upper clip member and the base member; and the grip member includes a slide mechanism for varying the spacing between the upper clip member and the base member.

12. The apparatus of claim 10 wherein:

the plurality of grooves are aligned in parallel on the bottom surface of the upper clip member to accommodate containers of different diameters, and are curved lengthwise to match a circular shape of the top rim of the beverage container.

13. The apparatus of claim 10 wherein:

the grip member has at least one flat surface for receiving a mark.

14. The apparatus of claim 10 wherein:

the grip member has a curved shape, and includes at least one protuberance on a surface that faces towards the beverage container.

15. The apparatus of claim 10 wherein:

the upper clip member includes a hole to accommodate a drinking straw.

16. The apparatus of claim 10 wherein:

the base member includes a circular groove in the bottom of the circular recess for holding the bottom of a beverage can.

17. The apparatus of claim 10 wherein:

the base member includes a hole in the bottom of the circular recess for a drain.

* * * * *